United States Patent [19]

Yamamoto

[11] Patent Number: 4,605,252

[45] Date of Patent: Aug. 12, 1986

[54] APPARATUS FOR RETAINING A SASH IN OPEN POSITION IN A PROJECTED WINDOW

[75] Inventor: Yukio Yamamoto, Tokyo, Japan

[73] Assignee: Yoshida Kogyo K. K., Tokyo, Japan

[21] Appl. No.: 716,551

[22] Filed: Mar. 27, 1985

[51] Int. Cl.[4] ..... E05C 17/30

[52] U.S. Cl. ..... 292/338; 49/325; 292/262

[58] Field of Search ..... 49/325; 292/338, 339, 292/262, 270, 278, DIG. 46

[56] References Cited

U.S. PATENT DOCUMENTS

| | | | |
|---|---|---|---|
| 2,017,543 | 10/1935 | Madsen | 49/325 X |
| 2,720,008 | 10/1955 | Topp | 292/262 X |
| 3,773,371 | 11/1973 | Carlsson | 292/262 |
| 4,456,291 | 6/1984 | Brogie | 292/338 |

*Primary Examiner*—Richard E. Moore

*Attorney, Agent, or Firm*—Hill, Van Santen, Steadman & Simpson

[57] ABSTRACT

An apparatus, for retaining a sash in a desired open position in a projected window, comprises at least one retaining unit adapted to be mounted on an outer frame, and at least one transforming unit adapted to be mounted within an inner frame. The retaining unit includes a tube-like member adapted to be pivotally connected to the outer frame, and a rod turnably and telescopically received in the tube-like member. The transforming unit is operatively connected to a handle (on the inner frame) and the rod for, in response to angular movement of the handle, turning the rod between a first position in which the rod is prevented from being longitudinally or axially moved relative to the tube-like member and a second position in which the rod is allowed to be longitudinally or axially moved relative to the tube-like member.

9 Claims, 13 Drawing Figures

APPARATUS FOR RETAINING A SASH IN OPEN POSITION IN A PROJECTED WINDOW

BACKGROUND OF THE INVENTION

1. Field of the Invention

The present invention relates to a projected window in which a sash is pivotally mounted in an outer frame for swinging movements between open and closed positions, and more particularly to an apparatus for retaining a sash in open position in a projected window.

2. Prior Art

Attempts have been made to retain a window sash adjustably in open position in an outer frame. To this end, a known retaining device comprises a stay arm pivotally mounted on a lower horizontal frame member of the sash, a slide mounted on a sill of the outer frame and slidably received in a groove in a free end of the stay arm, and a fastener, such as a bolt and a nut, for fixedly securing the slide adjustably in the groove. As the fastener is unfastened, the slide is slidable along the groove in the stay arm so that the sash is allowed to be moved to a desired open position by operating a handle. Then the fastener is again fastened to retain the sash in such desired open position.

Thus the known device is disadvantageous in that in addition to operating the handle, it is necessary to unfasten and fasten the fastener everytime the sash is to be moved to and retained in a desired open position. Further, since the fastening and unfastening of the fastener needs to be accomplished by hand, the prior stay arm can be furnished only between the sill (of the outer frame) and the lower frame member (of the sash), which are within the operator's reach. Having only a single stay arm, it is difficult to retain the sash stably in open position.

SUMMARY OF THE INVENTION

According to the present invention, a sash retaining apparatus comprises at least one retaining unit adapted to be mounted on an outer frame, and at least one transforming unit adapted to be mounted within an inner frame. The retaining unit includes a tube-like member adapted to be pivotally connected to the outer frame, and a rod turnably and telescopically received in the tube-like member. The transforming unit is operatively connected to a handle (on the inner frame) and the rod for, in response to angular movement of the handle, turning the rod between a first position in which the rod is prevented from being longitudinally or axially moved relative to the tube-like member and a second position in which the rod is allowed to be longitudinally or axially moved relative to the tube-like member.

It is therefore an object of the present invention to provide a sash-retaining apparatus for a projected window, in which a retaining unit or units can be actuated between a "retained" position and a "released" position simply by operating a handle.

Another object of the invention is to provide a sash-retaining apparatus, for a projected window, with which a retaining unit can be furnished between a header (of an outer frame) and an upper frame member (of a sash), which are out of the operator's reach, thus retaining the sash in a desired open position easily with adequate stableness.

Many other advantages, features and additional objects of the present invention will become manifest to those versed in the art upon making reference to the detailed description and the accompanying drawings in which certain preferred embodiments incorporating the principles of the present invention are shown by way of illustrative example.

DETAILED DESCRIPTION

Figure 1:
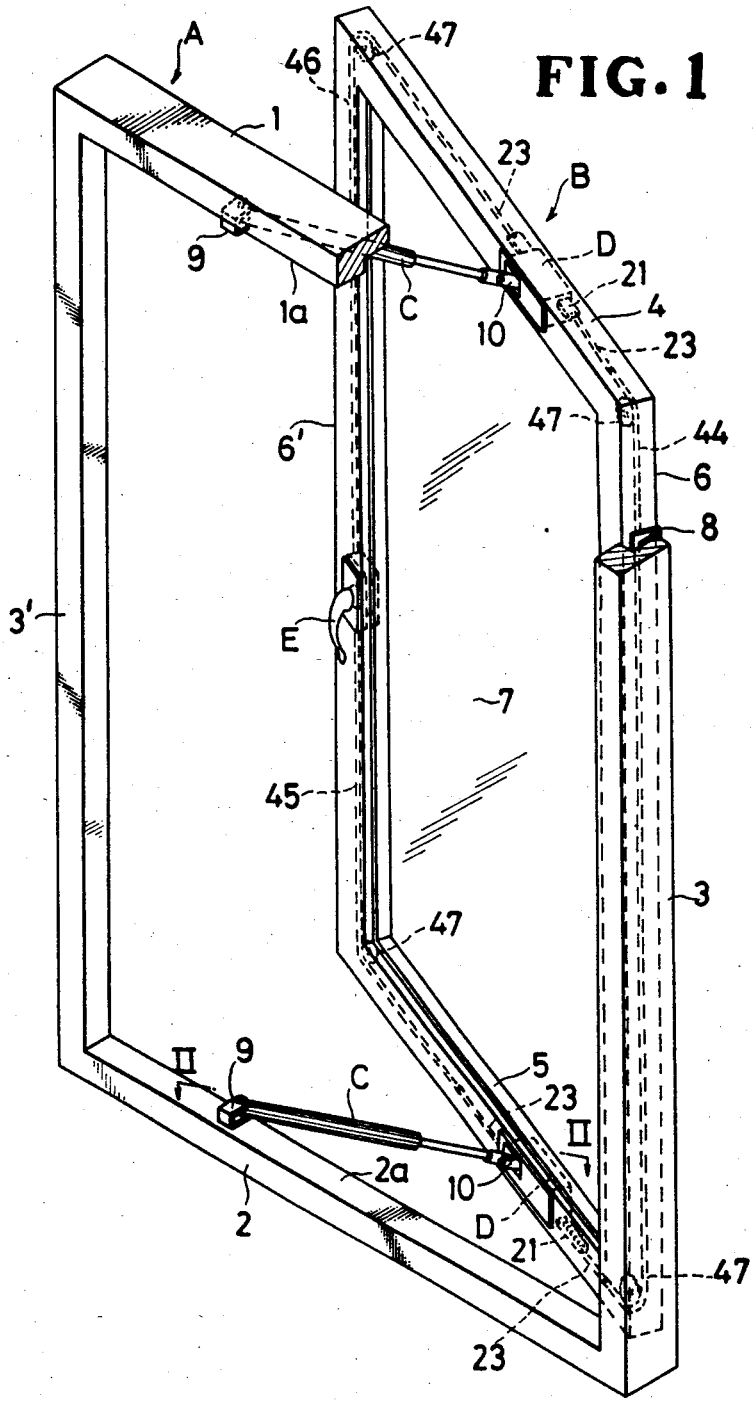
FIG. 1 is a perspective view, with parts broken away, of a projected window in which a sash is held in open position by a retaining apparatus embodying the present invention.

FIG. 1 shows a projected window in which a sash is held in open position by means of a retaining apparatus embodying the present invention. The window indudes a rectangular outer frame A composed of a header 1, a sill 2, and a pair of side jambs 3, 3'. The sash includes a rectangular inner frame B composed of an upper horizontal frame member 4, a lower horizontal frame member 5, and a pair of vertical side frame members or stiles 6, 6' joined with the upper and lower frame members 4, 5 end to end, thus encircling a peripheral edge of a pane of glass 7. One of the side frame members 6 is connected to one of the side jambs 3 by means of a hinge 8 so that the sash is horizontally and exteriorly swingable on the one side jamb 3.

The retaining apparatus generally comprises a pair of upper and lower retaining units C, C pivotally mounted on the header 1 and the sill 2, respectively, of the outer frame A, and a pair of upper and lower transforming units D, D mounted within the upper and lower frame members 4, 5, respectively, of the inner frame B, each of the transforming units D being operatively connected to a respective one of the retaining units C. A handle E is mounted on the other side frame members 6' for pivotal movement and is operatively connected to the upper and lower transforming units D, D and thus to the upper and lower retaining units C, C, as described below.

Figure 2:
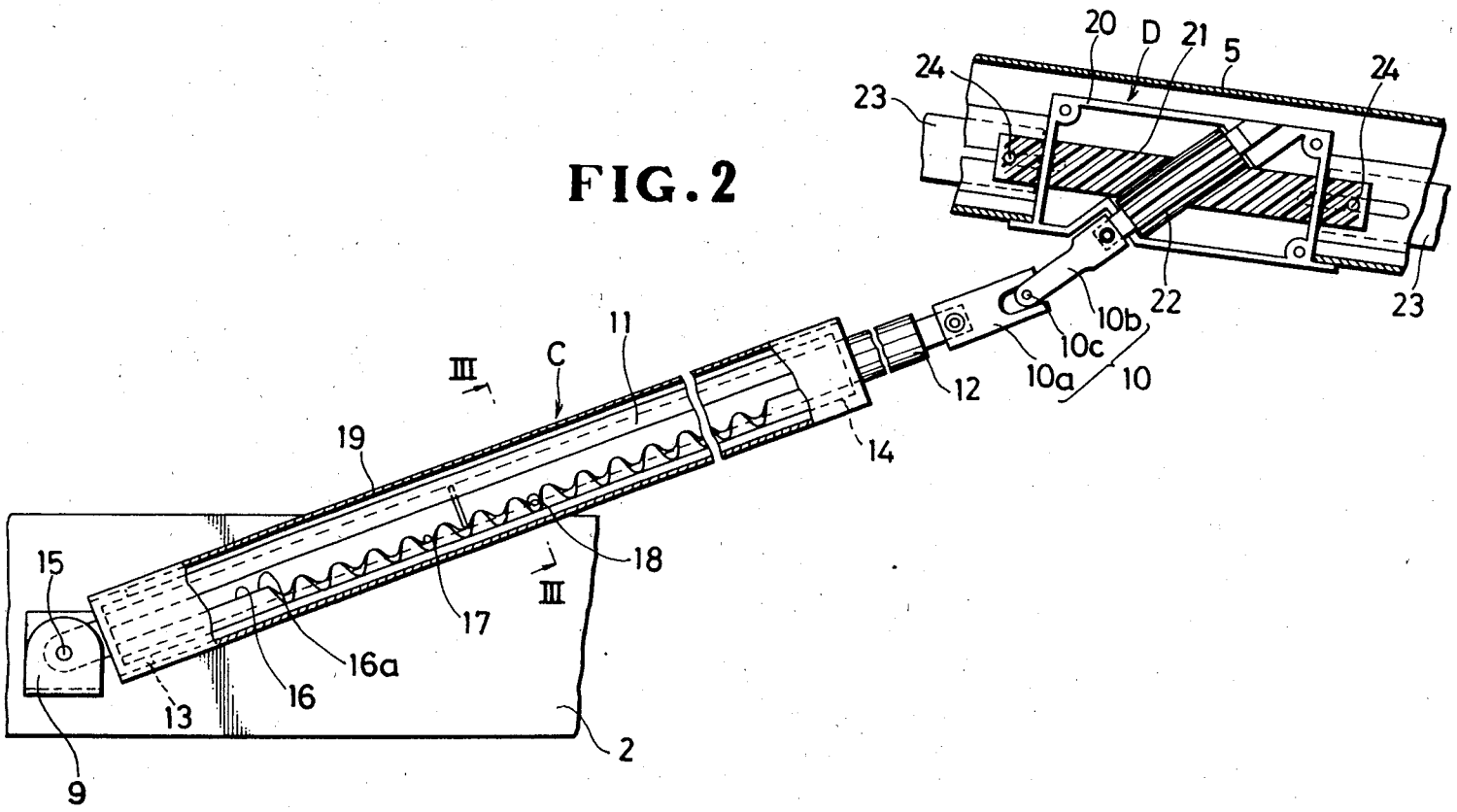
FIG. 2 is an enlarged cross-sectional view taken along line II—II of FIG. 1.

As shown in FIGS. 1 and 2, each of the upper and lower retaining units C is horizontally pivotally supported at one end thereof on an inner side 1*a*, 2*a* of a respective one of the header 1 and the sill 2 by means of a bracket 9. Each retaining unit C includes an elongated tube-like member 11 of generally circular cross section covered by a concentric hollow cylinder 19 extending between a pair of caps 13, 14, fitted in opposite ends of the tube-like member 11, one of the caps 13 being pivotally connected to the bracket 9 by a vertical pin 15 (FIG. 2). The tube-like member 11 has a longitudinal aperture 16 (FIGS. 2, 3 and llB) along its entire length; one of a pair of confronting aperture-defining edges 16*a* (FIG. 2) (of the tube-like member 11) is waved to provide therealong a plurality of uniformly spaced recesses 17, while the other aperture-defining edge is straight. Each retaining unit C also includes an elongated rod 12 (FIGS. 2 and 3) of circular cross section which is telescopically received in the tube-like member 11 and which has a locking pin 18 mounted on the rod 12 adjacent to one end thereof and projecting radially outwardly of the rod 12 into the aperture 16. The locking pin 18 slides along the aperture 16 as the rod 12 is moved axially in the tube-like member 11. The locking pin 18 is engageable in a selected one of the recesses 17 in the tube-like member 11 when the rod 12 is turned clockwise (FIG. 3) as described below. The cylinder 19 serves not only as a cover concealing the aperture 16 and the locking pin 18 to give a tidy appearance, but as a guard preventing dust and rain from coming into the tube-like member 11.

As shown in FIGS. 2, 4, 5 and 6, each of the upper and lower transforming units D includes a rectangular casing 20, a rack 21 extending through the casing 20 and slidable thereon, and a pinion 22 rotatably mounted in the casing 20 and gearing with the rack 21. The rack 21 extends in parallel relation to a pair of opposite longer sides of the casing 20 and has on its one side a series of first cogs 21*a* each extending obliquely, i.e. at an angle of about 45°, across the rack 21. The pinion 22 extends obliquely, i.e. at an angle corresponding to the inclination of the first cogs 21*a* and has on its periphery an endless series of second cogs each extending parallel to the axis of the pinion 22 through the entire length of the pinion 22. The pinion 22 has at its opposite ends a pair of axially aligned axle portions 22*a*, 22*b*.

Figure 5:
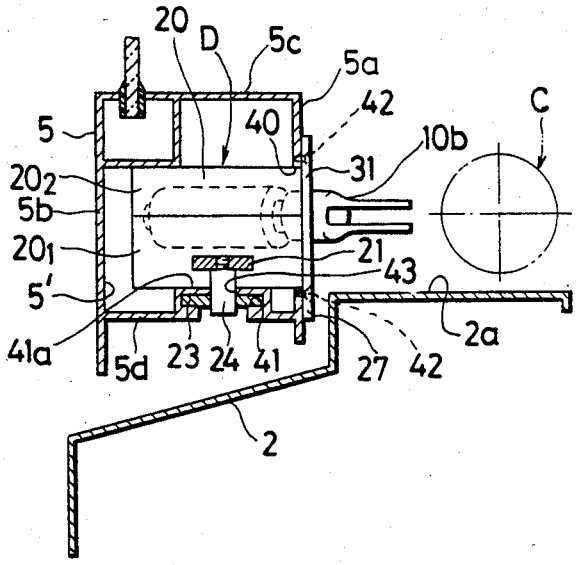
FIG. 5 is a fragmentary enlarged cross-sectional view of FIG. 1, showing a sill of an outer frame and a lower frame member of the sash while the latter is in closed position.
Figure 4:
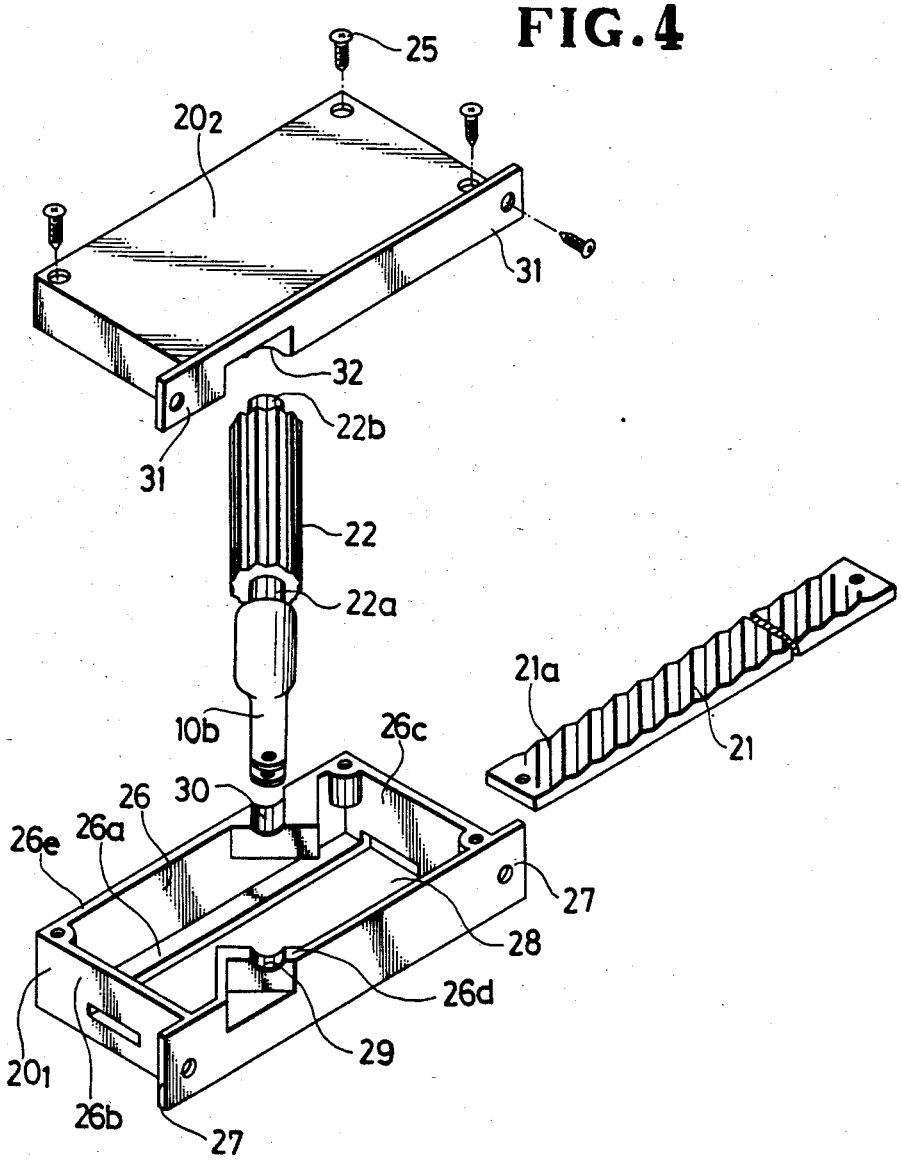
FIG. 4 is an enlarged perspective view of a transmission unit.

As best shown in FIGS. 2, 4 and 5, the rectangular casing 20 includes a pair of inner and outer (upper and lower) casing halves $20_2$, $20_1$ joined together by means of a plurality of screws 25. The outer (lower) casing half $20_1$ has a bottom 26*a*, a pair of opposed left and right (as viewed in FIG. 2) shorter sidewalls 26*b*, 26*c*, and a pair of opposed interior and exterior longer sidewalls 26*d*, 26*e*, the interior sidewall 26*d* extending in opposite directions beyond the respective shorter sidewalls 26*b*, 26*c* to provide a pair of first flanges 27, 27 which are secured to the corresponding horizontal frame member 4, 5 in a manner described below. The upper casing half $20_2$ has a pair of second flanges 31, 31 which are similar to the first flanges 27, 27 and which are secured to the corresponding horizontal frame member 4, 5 in a manner described below. .

In the outer (lower) casing half $20_1$, the shorter sidewalls 26*b*, 26*c* have a pair of aligned apertures for the passage of the rack 21, while the bottom 26*a* has a longitudinal guide groove 28 opening at opposite ends to the apertures in the shorter sidewalls 26*b*, 26*c* and having a depth smaller than the thickness of the rack 21. As the rack 21 slides longitudinally in the casing 20, the rack 21 is guided linearly along the guide groove 28.

The interior and exterior longer sidewalls 26*d*, 26*e* of the outer (lower) casing half 20, have in their respective upper edges a pair of interior and exterior bearing recesses 29, 30 of semi-circular cross section, while the interior and exterior longer sidewalls of the inner (upper) casing half $20_2$ have in their respective outer (lower) edges a pair of interior and exterior bearing recesses 32, 32 (only one illustrated in FIG. 4) of semi-circular cross section. As the inner and outer (upper and lower) casing halves $20_2$, $20_1$ are jointed together, the two interior bearing recesses 29, 32 in the inner and outer (upper and lower) casing halves $20_2$, $20_1$ are symmetrically opposed to jointly receive one of the axle portions 22*a* of the pinion 22 for rotation. Likewise the two exterior bearing recesses 30, 32 in the inner and outer (upper and lower) casing halves $20_2$, $20_1$ are symmetrically opposed to jointly receive the other axle portion 22*b* of the pinion 22 for rotation. Accordingly the pinion 22 is rotatable or turnable about its axis in the casing 20 in response to the linear movement of the rack 21.

As best shown in FIG. 2, the pinion 22 is operatively connected to the rod 12 via a universal joint 10 which includes a pair of first and second connecting members 10*a*, 10*b*. The first connecting member 10*a* is secured at one end to the other or outer end of the rod 12 and is pivotally connected at the other (or bifurcated) end to one (or bifurcated) end of the second connecting member 10*b* by means of a pin 10*c*, the other end of the second connecting member 10*b* being secured to the one axle portion 22*a* of the pinion 22. Accordingly the rod 12 is rotatable or turnable about its axis in the tube-like member 11 in response to the rotation or turning of the pinion 22.

Figure 6:
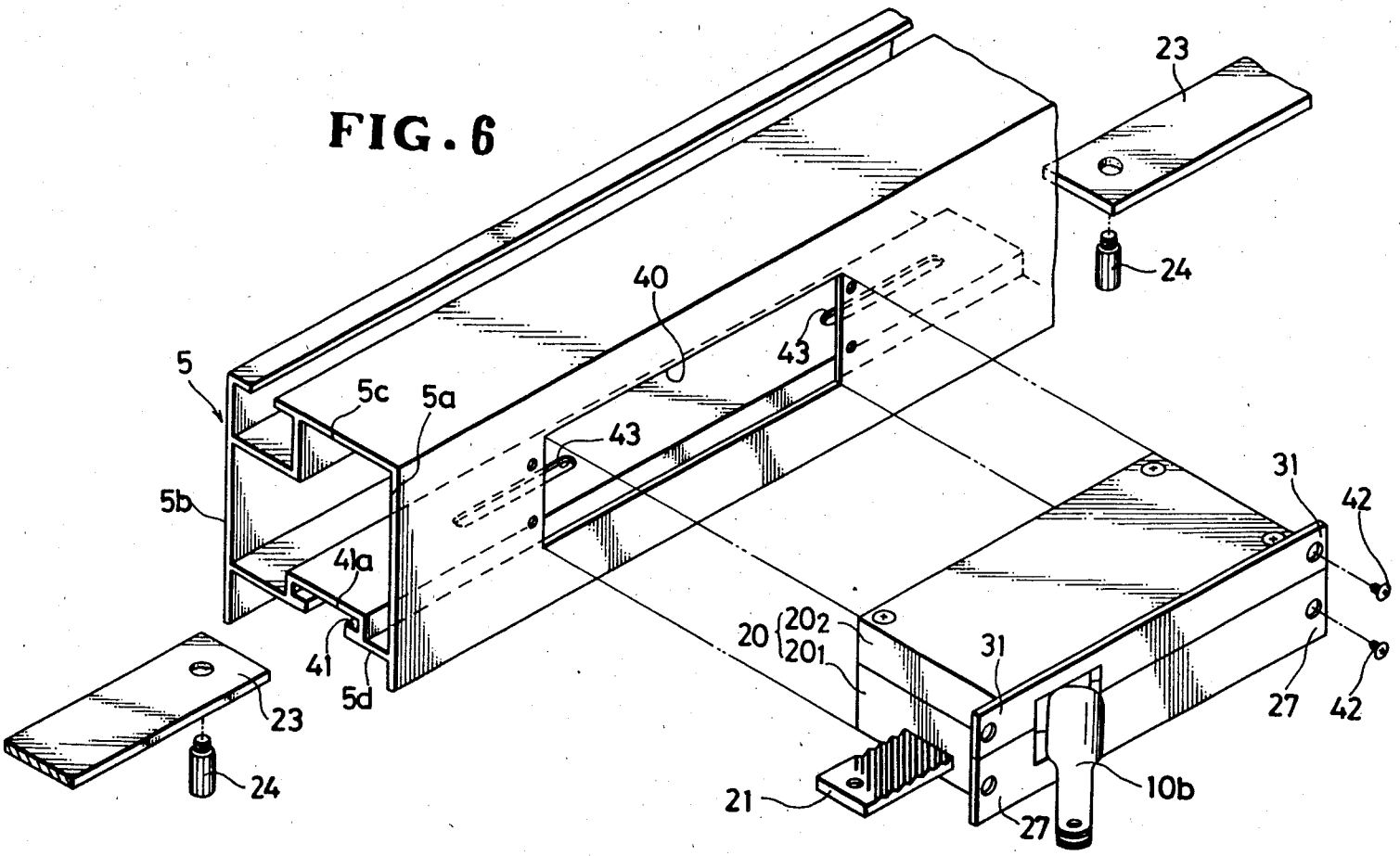
FIG. 6 is an enlarged exploded perspective view, with parts broken away, of FIG. 5, illustrating the manner in which the transforming unit is mounted on the lower frame member of the sash.
Figure 7:
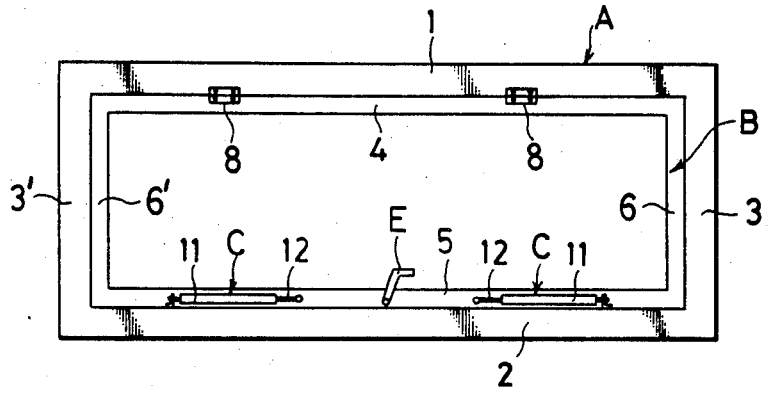
FIG. 7 is a front elevational view of an over-hang window in which a modified retaining apparatus is employed.
Figure 8:
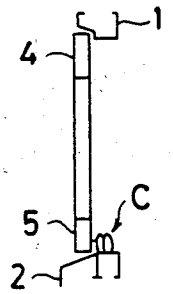
FIG. 8 is a schematic vertical cross-sectional view of FIG. 7.

As shown in FIGS. 5 and 6, each of the upper and lower horizontal frame members 4, 5 (only lower frame member is illustrated for clarity) includes a pair of parallel interior and exterior vertical walls 5*a*, 5*b* and a pair of inner and outer (upper and lower in FIGS. 5 and 6) horizontal walls 5*c*, 5*d* extending between the interior and exterior vertical walls 5*a*, 5*b* to define therebetween a hollow 5' along the entire length of the frame member 5. The outer (lower) horizontal wall 5*d* has a longitudinal central portion of a generally C-shaped cross section defining an outwardly (downwardly) facing guide channel 41 in which a pair of slides 23, 23 is received. The outer horizontal wall 5*d* has, in the central portion and thus in a bottom 41*a* of the guide channel 41, a pair of longitudinally spaced elongate slots 43, 43. A pair of outwardly (downwardly) directed studs 24, 24 are mounted on opposite end portions of the rack 21 and extend through the respective slots 43, 43 into a pair of openings in the respective slides 23, 23, thus operatively connecting the latter to the rack 21. As the slides 23, 23 are moved along the guide channel 41, the rack 21 slides along the guide groove 28 in the bottom 26*a* of the outer (lower) casing half $20_1$. Each slot 43 and the corresponding stud 24 jointly serves to restrict the stroke of the respective slide 23 and thus of the rack 21.

For mounting, the casing 20 is inserted through a rectangular opening 40 in the interior vertical wall 5*a* of the horizontal frame member 5 (of the sash B) until the four flanges 27, 27, 31, 31 abut the interior surface of the interior vertical wall 5*a*. The four flanges 27, 27, 31, 31 are then secured to the interior vertical wall 5*a* by means of the four screws 42, 42, 42, 42 (only two screws shown in FIGS. 6), respectively.

As shown in FIG. 1, one of the slides 23 in the lower horizontal frame member 5 (of the inner frame B) is connected to one of the slides 23 in the upper horizontal frame member 4 by a first connecting rope or chain 44 which extends through the right stile 6 and which is guided by a pair of pulleys or sprocket wheels 47, 47 each mounted at opposite ends of the right stile 6. The other slide 23 in the lower horizontal frame member 5 is operatively connected to the handle E by a second connecting rope or chain 45 which extends through a lower part of the left stile 6' and which is guided by a pulley or sprocket wheel 47 mounted at a lower end of the left stile 6'. Likewise the other slide 23 in the upper horizontal frame member 4 is operatively connected to the handle E by a third connecting rope or chain 46 which extends through an upper part of the left stile 6' and which is guided by a pulley or sprocket wheel 47 mounted at an upper end of the left stile 6'. The handle E is angularly movable, on the left stile 6', through a predetermined angle between a "retained" position (FIG. 1) in which the handle E is directed downwardly, and a "released" position (not shown) in which the handle E is directed sideways.

While the handle E is in the "retained" position (FIG. 1), the locking pin 18 of the rod 12 (of each retaining unit C) is disposed against the waved edge **16*a* of the tube-like member 11 and is engaged in a selected one of the recesses 17 (FIG. 2), thus preventing the rod 12 from being axially moved relative to the tube-like member 11**. The sash is thus retained in open position.

Figure 3:
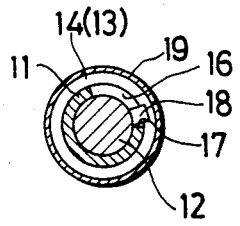
FIG 3 is a cross-sectional view taken along line III—III of FIG. 2.

When the handle E is angularly moved counterclockwise (FIG. 1) from the "retained" position to the "released" position, the rack 21 of the lower transforming unit D is moved linearly rightwardly (FIG. 2) in the casing 20. In response to the linear rightward movement of the rack 21, the pinion 22 in the same casing 20 is rotated or turned counterclockwise (as viewed from the interior side of the window). This counterclockwise turning of the pinion 22 causes the rod 12 (of the upper retaining unit C) to be turned counterclockwise (FIG. 3). As a result, the locking stud 18 is released from the one recess 17 in the waved edge **16*a* of the tube-like member 11 so that the rod 12 is allowed to be axially moved relative to the tube-like member 11**.

Meanwhile, the rack 21 of the upper transforming unit D is moved linearly leftwardly (as viewed from the interior side of the window) in the casing 20. In response to the linear leftward movement of the rack 20, the pinion 22 in the same casing 20 is rotated or turned counterclockwise. This counterclockwise turning of the pinion 22 causes the rod 12 (of the upper retaining unit C) to be turned in the same direction. As a result, the locking stud 18 is released from one of the recesses 17 in the waved edge **16*a* of the tube-like member 11 so that the rod 12 is allowed to be axially moved relative to the tube-like member 11**.

In this condition, the rod 12 of each of the retaining units C can be extended and shrunk by pushing the sash exteriorly and by pulling the sash interiorly, respectively, to vary the extent to which the sash is opened.

Reversely, as the handle E is angularly moved from the "released" position to the "retained" position, the rack 21 of the lower transforming unit D is moved leftwardly (FIG. 2) in the casing 20. In response to the leftward movement of the rack 21, the pinion 22 in the same casing 20 is rotated or turned clockwise (as viewed from the interior side of the window). This clockwise turning of the pinion 22 causes the rod 12 (of the lower retaining unit C) to be turned clockwise. As a result, the locking stud 18 is disposed against the waved edge **16*a* of the tube-like member 11 and is engaged in a selected one of the recesses 17, thus preventing the rod 12 from being axially moved relative to the tube-like member 11**.

Meanwhile, the rack 21 of the upper transforming unit D is moved rightwardly (as viewed from the interior side of the window). In response to the rightward movement of the rack 21, the pinion 22 in the same casing 20 is rotated or turned clockwise. This clockwise turning of the pinion 22 causes the rod 12 (of the upper retaining unit C) to be turned clockwise. As a result, the locking stud 18 is disposed against the waved edge **16*a* of the tube-like member 11 and is engaged in a selected one of the recesses 17, thus preventing the rod 12 from being axially moved relative to the tube-like member 11**.

In this condition, the sash is retained in a selected one of the open positions.

Figure 11A:
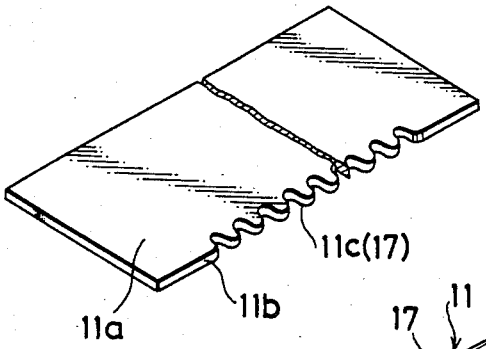
FIGS. 11A and 11B are perspective views illustrating respective processing steps in which a tube-like member of the retaining unit is made.
Figure 11B:
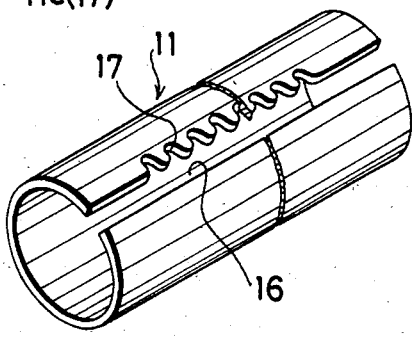
Figure 12:
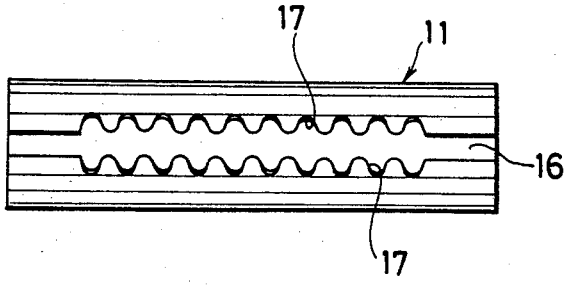
FIG. 12 is a plan view of a modified form of the tube-like member.

The tube-like member 11 of each retaining unit C is made from a rectangular flat blank plate **11*a* (FIG. 11A) having in a longitudinal edge 11*b* a plurality of recesses 11*c* (prospective recesses 17). The flat blank plate 11*a* is then bent into a tubular shape of circular cross section (FIG. 11B). FIG. 12 shows an alternative form of the tube-like member 11, in which there are a plurality of recesses 17** in each of a pair of confronting aperture-defining edges.

FIGS. 7 through 10 show an over hang window in which the sash is pivotally supported on the header 1 by means of a pair of hinges 8, 8 and in which a modified retaining apparatus is employed. The modified retaining apparatus comprises a pair of retaining units C, C pivotally mounted on the sill 2 of the outer frame A, and a pair of transforming units D, D mounted within the lower frame member 5 of the inner frame B, each of the transforming units D being operatively connected to a respective one of the retaining units C in the same manner as in the embodiment of FIGS. 1 and 2.

Figure 9:
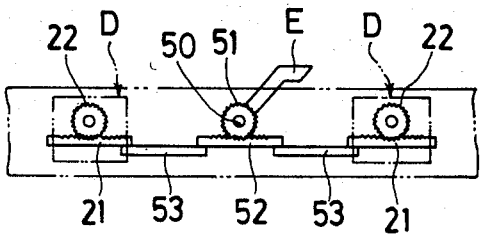
FIG. 9 is a fragmentary enlarged front elevational view of the modified retaining apparatus of FIG. 7, illustrating the manner in which a handle is operatively connected with a pair of transforming units.
Figure 10:
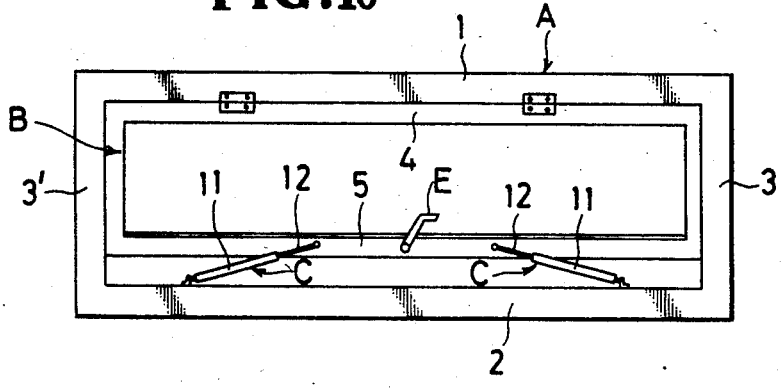
FIG. 10 is a front elevational view showing the overhang window of FIG. 7 in open position.

In the modified retaining apparatus, a handle E is mounted on the lower frame member 5 of the inner frame B between the two transforming units D, D. As shown in FIG. 9, a pinion 51 is mounted on an axle 50 of the handle E and is operatively connected to the racks 21, 21 of the transforming units D, D by means of an additional rack 52 and a pair of connecting bars 53, 53, the rack 52 gearing with the pinion 51. Each of the connecting bars 53 is connected at one end to the rack 52 and at the other end to a respective one of the racks 21. In operation, as the handle E is angularly moved counterclockwise about the axle 50 thereof, the pinion 51 is turned counterclockwise to move the rack 52 linearly rightwardly (FIG. 9). In response to the linear rightward movement of the rack 52, the rack 21 of each transforming unit D slides linearly rightwardly to rotate or turn the corresponding pinion 21 counterclockwise. This counterclockwise turning of each pinion 21 causes the corresponding rod 12 to be rotated or turned in the same direction. As a result, the rod 12 of each retaining unit C is allowed to be axially moved relative to the tube-like member 11 in the same manner as in the embodiment or FIGS. 1 and 2. In this condition, the rod 12 can be extended and shrunk to vary the extent to which the sash is opened.

Reversely, as the handle E is angularly moved clockwise, the pinion 51 is turned clockwise to move the rack 52 linearly leftwardly (FIG. 9). In response to the linear leftward movement of the rack 52, the rack 21 of each transforming unit D slides linearly leftwardly to rotate or turn the corresponding pinion 21 clockwise. This clockwise turning of each pinion 21 causes the corresponding rod 12 to be rotated or turned in the same direction. As a result, the rod 12 of each retaining unit C is prevented from being axially moved relative to the tube-like member 11 in the same manner as in the embodiment of FIGS. 1 and 2.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for retaining a pivotally adjustable inner window frame in open position on an outer frame, said apparatus comprising:

(a) a handle having means enabling it to be mounted on the inner frame for angular movement through a predetermined angle between a "retained" position and a "released" position;

(b) at least one retaining unit having means enabling it to be mounted on the outer frame, said retaining unit including an elongated first member having means at one and enabling it to be pivotally connected to the outer frame, and an elongated second member telescopicaly connected to said first member, said second member, in response to the angular movement of said handle between the "retained" and "released" position, having means enabling it to be turnable between a first position in which said second member is longitudinally locked relative to said first member and a second position in which said second member is longitudinally movable relative to said first member; and (c) at least one transforming unit having means enabling it to be mounted within the inner frame, said transforming unit being operatively connected to said handle and said second member for, in response to the angular movement of said handle, turning said second member between said first and second positions.

2. An apparatus according to claim 1, said second member being connected to said first member by such means that, when said second member is turned in one of opposite directions, said second member assumes said first position, and when said second member is turned in the other direction, said second member assumes said second position.

3. An apparatus according to claim 1, said first member including a tube-like member of generally circular cross section having a longitudinal aperture, said tube-like member having in one of a pair of confronting aperture-defining edges a plurality of recesses, said second member including a rod of circular cross section slidably received in said tube-like member, said rod having at one end portion thereof a radial locking stud projecting into said aperture, said locking stud being, when said rod is in said first position, engaged in a selected one of said recesses in said tube-like member, and said locking stud being, when said rod is in said second position, released from said one aperture-defining edge and thus from said recesses.

4. An apparatus according to claim 1, said first member including a tube-like member of generally circular cross section having a longitudinal aperture, said tube-like member having in each of a pair of confronting aperture-defining edges a plurality of recesses, said second member including a rod of circular cross section slidably received in said tube-like member, said rod having at one end portion thereof a radial locking stud projecting into said aperture, said locking stud being, when said rod is in said first position, engaged in a selected one of said recesses in said tube-like member, and said locking stud being, when said rod is in said second position, released from said aperture-defining edges and thus from said recesses.

5. An apparatus according to claim 1, said transforming unit including a casing having means enabling it to be mounted within the inner frame, a pinion rotatably mounted within said casing and corotatably connected to said second member, and a rack extending through said casing and gearing with said pinion, said rack being connected to said handle via at least one connecting member, said rack being, in response to the angular movement of said handle, slidable linearly in said casing to turn said pinion.

6. An apparatus according to claim 5, further including an additional pinion mounted on an axle of said handle, an additional rack slidably mounted within the inner frame and gearing with said pinion, said additional rack being connected to said rack of said transforming unit for sliding linearly in response to the angular movement of said handle.

7. An apparatus according to claim 3, said retaining unit further including a hollow cylinder extending around a periphery of said tube-like member so as to conceal said aperture and said locking stud.

8. An apparatus according to claim 5, said rack having on its one side a series of first cogs each extending obliquely across said rack, said pinion extending obliquely at an angle corresponding to the inclination of said first cogs of said rack and having on its periphery an endless series of second cogs each extending parallel to the axis of said pinion.

9. An apparatus according to claim 5, said pinion being connected to said second member by means of a universal joint.

* * * * *